US007461682B2

(12) United States Patent
Biktjorn et al.

(10) Patent No.: US 7,461,682 B2
(45) Date of Patent: Dec. 9, 2008

(54) METHOD AND APPARATUS FOR SERIALLY APPLYING AN ADHESIVE ONTO MEMBERS OF ONE OR MORE WOOD STACKS

(76) Inventors: Kenneth Biktjorn, 14 Surrey Rd., Chester, NY (US) 10918; Espen Vige, Andås veien 104, Flekkerøy (NO) 4625

( * ) Notice: Subject to any disclaimer, the term of this patent is extended or adjusted under 35 U.S.C. 154(b) by 0 days.

(21) Appl. No.: 11/580,340

(22) Filed: Oct. 12, 2006

(65) Prior Publication Data

US 2008/0087383 A1 Apr. 17, 2008

(51) Int. Cl.

| | |
|---|---|
| ***B29C 65/52*** | (2006.01) |
| ***B32B 37/10*** | (2006.01) |
| ***B32B 37/14*** | (2006.01) |
| ***B32B 41/00*** | (2006.01) |
| *B32B 41/02* | (2006.01) |
| *B29C 65/54* | (2006.01) |

(52) U.S. Cl. ..... 156/556; 156/295; 156/356; 156/362; 156/539

(58) Field of Classification Search ..... 156/295, 156/297, 356, 362, 539, 556, 566; 221/76
See application file for complete search history.

(56) References Cited

U.S. PATENT DOCUMENTS

| | | | | |
|---|---|---|---|---|
| 3,255,067 | A * | 6/1966 | Sontheim et al. | 156/522 |
| 5,518,574 | A * | 5/1996 | Yates et al. | 156/356 |
| 5,672,310 | A * | 9/1997 | Watanabe | 264/297.4 |
| 2005/0043160 | A1 * | 2/2005 | Neubauer et al. | 493/356 |
| 2006/0204658 | A1 | 9/2006 | Anderson | |

FOREIGN PATENT DOCUMENTS

| | | | |
|---|---|---|---|
| DE | 3301614 | A * | 7/1984 |
| JP | 08217246 | A * | 8/1996 |
| NO | 322165 | | 3/2005 |
| SE | 503 121 | | 3/1996 |
| WO | WO 99/56888 | | 11/1999 |

OTHER PUBLICATIONS

English translation of SE503121; Maartenson, Goeran. Mar. 25, 1996.*

* cited by examiner

*Primary Examiner*—Philip C Tucker
*Assistant Examiner*—Sonya Mazumdar
(74) *Attorney, Agent, or Firm*—Leason Ellis LLP

(57) ABSTRACT

Serial application of adhesive onto members of one or more wood stacks has controllable supply of pressurized adhesive dispensed onto one face of the member from the adhesive supply, and a mechanism operable to advance stacked supply of members to a platform for adhesive application and a conveyor operable to position a next stack, upon exhaustion of a current stack, in a position from which a member can be adhesively coated. The invention also provides a method in order to operate the apparatus.

11 Claims, 5 Drawing Sheets

METHOD AND APPARATUS FOR SERIALLY APPLYING AN ADHESIVE ONTO MEMBERS OF ONE OR MORE WOOD STACKS

FIELD OF THE INVENTION

The present invention relates to a method and apparatus for serially applying an adhesive such as onto wood flooring and other building elements. The building elements may take the form of solid pieces of wood used for flooring that have tongue and groove sides and come in either pre-finished or unfinished styles. The building elements may also take the form of the wooden slats used to lay parquet floors, which is a mosaic of wood used for ornamental flooring.

BACKGROUND OF THE INVENTION

It is well known to home owners and prospective buyers around the world that the elegance of a hardwood floor lends warmth and character to any room in a home. Wood's natural characteristics add depth to any room as well as a visual appearance that many other types of floors can only attempt to duplicate, with varying degrees of success. Due to an increasing demand for hardwood flooring, manufacturers are enhancing their ranges of woods and styles to meet the increased demand. Manufacturers are also offering woods having higher quality finishes and constructed using superior techniques. Homeowners now have available to them a vast array of wood species, colors and widths from which to choose. The classic hardwoods (such as red oak, white oak, maple and ash) remain as popular as ever, but now many manufacturers even offer exotic hardwood species that come from all over the World. Homeowners can better express their own personal decorating tastes with a more unique looking floor that comes from the use of exotic hardwoods. There has never been a more dizzying array of hardwood floors available than there are now, which often makes the choice of appropriate hardwood flooring very difficult for homeowners.

The most aesthetically pleasing and durable floor imaginable, however, can entail considerable expense owing to the costs of the wood itself, which may hamper the ability to achieve the finished product in a practical or economical way. Add to that the additional significant labor expenses stemming from the time required for undertaking the installation of the floor.

The traditional method of laying parquet floors entails the application of adhesive to a floor base or surface using a trowel and then placing the parquet panels on top of the adhesive in a desired pattern. While the method works to produce the desired floor, it is fraught with potential problems. One such problem is that by applying adhesive to the floor support, the craftsman runs the risk of finding a quantity of adhesive creeping into the tongue and groove joint between the parquet panels when they are pushed into place. The excess misplaced adhesive has the undesired effect of preventing the joints between parquet panels from being completely tight. This will effect some parquet patterns more than others, but for all patterns one can expect gaps to eventually appear between successively applied panels, marring the floor's appearance.

One remedy to the above-described problem is to apply the adhesive directly to the underside of the parquet panel instead of the floor base, and then proceeding with the placement of panels on the base. However, while the problem of adhesive creep has been addressed, there remain other problems in this manual labor-intensive process. A craftsman who applies adhesive to the rear face of each parquet element using a trowel or other suitable adhesive distributor faces an arduous and messy task. There is always the possibility of dripping adhesive from the trowel or spilling the supply container. Another problem is the likelihood that the adhesive will be exposed to the air for an undesirably long period of time, possibly causing it to increase in viscosity or even to dry. This can happen because the complete handling and placement of each element by the craftsman, from application of adhesive to mounting of the element in the proper position and retrieval of the next element, is time-consuming. Excessive time requirements for completing the job will in turn lead the cost of the work to rise prohibitively for the consumer. Further, excessive time works to the disadvantage of the floor layer, because he can take on fewer jobs and will earn less as a result.

Labor-saving adhesive applicator devices are known in the art. One such device is disclosed in PCT application publication number WO 99/56888, wherein each parquet element is pushed past a stationary adhesive applicator. Swedish patent number 503121 discloses a movable adhesive applicator for applying adhesive to a groove located along a longitudinal edge of the lowermost element in a stack of flooring elements. Norwegian patent number NO20034092 discloses an apparatus for applying an adhesive onto one face of a flat building element which also includes a movable adhesive applicator, and which retrieves the uppermost element from a single supply stack for application of adhesive.

The present invention fulfills a need in the art for a method which enables serial application of adhesive onto members of one or more wood stacks without the necessity of manually placing the members in position for application of adhesive, which will have the effect of making the process faster and safer. The present invention also fulfills a need in the art for a method and apparatus which will minimize or eliminate the cumbersome manual movement of successive supply stacks of elements to a position from which the next element can be placed in position for application of adhesive.

SUMMARY OF THE INVENTION

In accordance with one aspect of the invention, a method is provided for serially applying an adhesive onto members of one or more wood stacks to provide for subsequent adhesive assisted attachment of the members to a surface, the method comprising one or more times carrying out the steps of: retrieving an uppermost member from a stacked supply of members; adjusting upon each retrieval of each member an uppermost level of the supply so that the uppermost member in the stacked supply of members is always at a prescribed level; locating the retrieved member in a stationary position remote from the stacked supply; moving a carriage with an associated adhesive supply along the retrieved member between the ends thereof; applying pressurized adhesive from the adhesive supply in a predetermined pattern onto the member over its full length during the moving step and while the member is held stationary; and stationarily locating by non-manual means a subsequent stack, upon exhaustion of the current stack, in a position from which the uppermost member can be retrieved.

In accordance with another aspect of the invention, a method is provided for serially applying an adhesive onto members of one or more wood stacks to provide for subsequent adhesive assisted attachment of the members to a surface, the method comprising one or more times carrying out the steps of: retrieving a lowermost member from a stacked supply of members and moving it relative to one or more adhesive applicator nozzles; applying pressurized adhesive from the adhesive applicator nozzles onto the member over its full length or some portion thereof, the next-highest member descending due to the force of gravity upon each retrieval of a member, so that a lowermost member in the stacked supply of members will always be at a prescribed level; stationarily locating by non-manual means a subsequent stack, upon exhaustion of the current stack, in a position from which the lowermost member can be retrieved.

Suitably, the building element is a parquet floor element or parquet block, and the surface is a flooring base.

Furthermore, the invention provides for an apparatus for serially applying an adhesive onto members of one or more wood stacks to facilitate the adhesive-assisted attachment of the members to a surface after removal of each member from the apparatus. In a preferred embodiment, the apparatus comprises: a holder to hold a plurality of members in a stacked supply; a jig for stationarily locating the members, one at a time, each member being retrievable from the stacked supply as an uppermost member of the supply, and the jig having an associated platform to support the retrieved member; a carriage with an associated adhesive supply, the carriage being configured in a controllable manner to be movable along the jig and thereby along the retrieved member when located on the platform between a first end region of the member and a second end region thereof; a means for controllably supplying pressurized adhesive onto one face of the member from the adhesive supply via an adhesive applicator device while the carriage is caused to move along the member over its full length or some portion thereof; adjustment means being operative with the holder for stepwise or step-free adjustment of an uppermost level of the supply of members in order to let an uppermost member in the stacked supply of members assume a predetermined level close to or at a level of the platform; and conveyor means for storing a plurality of stacks and operable to place the next stack, upon exhaustion of the current stack, in a position from which the uppermost member can be retrieved.

Suitably, the movement of the carriage is a continuous and steady movement along the length of the member.

In a preferred embodiment, the apparatus is useful for handling a building element in the form of a parquet floor element or a parquet block. Then, the support is a flooring base. The apparatus is also useful for handling engineered floors and all types of strip flooring of various widths and lengths.

The carriage is suitably motor driven via a belt drive or via a rotary screw which extends substantially along a full length of the platform.

The carriage is suitably configured to provide application of adhesive onto the one face in a predetermined pattern, and the one face is a rear face of the building element.

Further, the invention provides for an additional apparatus for serially applying an adhesive onto members of one or more wood stacks to facilitate the adhesive-assisted attachment of the members to a surface after removal of each member from the apparatus. In a preferred embodiment, the apparatus comprises: an elongate element having an upper elongate contact face for members to which a coating, preferably adhesive, is to be applied; a coating applicator arranged above the contact face; a storage site for a stack of articles at one end of the elongate contact face; one or more bars projecting sideways out from the elongate element; a pusher means for pushing a lowermost member in the stack onto and along the elongate contact face, under and past the coating applicator; and conveyor means for storing a plurality of stacks and operable to place the next stack, upon exhaustion of the current stack, in a position at one end of the elongate contact face from which the lowermost member can be pushed onto and along the elongate contact face, under and past the coating applicator.

BRIEF DESCRIPTION OF THE DRAWING FIGURES

DETAILED DESCRIPTION OF CERTAIN EMBODIMENTS

Figure 1:
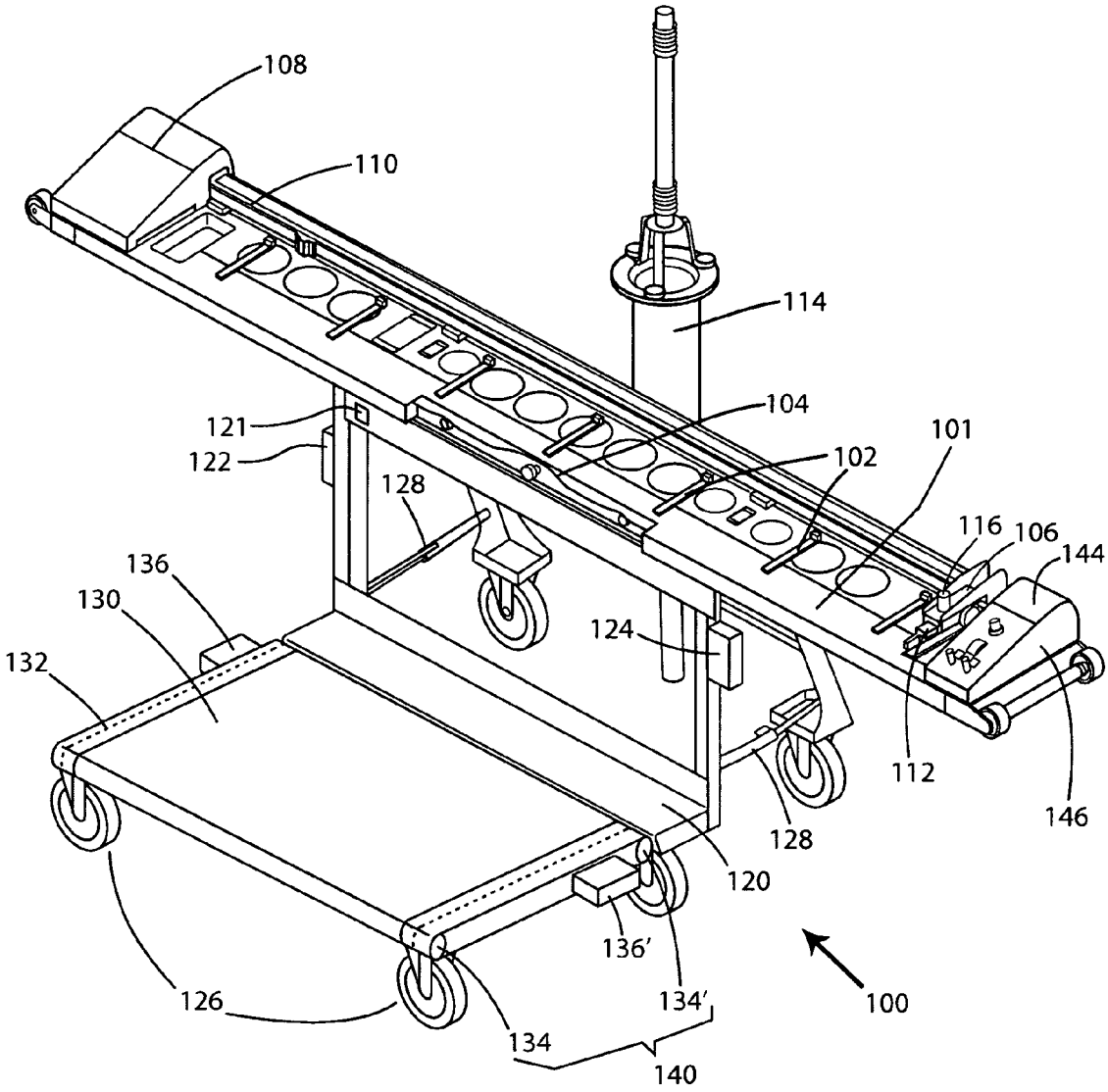
FIG. 1 is a perspective view of a first embodiment in accordance with the invention, without building elements located thereon.

The methods and apparatuses of the present invention are described with reference to the accompanying drawings. FIG. 1 shows one such apparatus 100 according to a first embodiment with a platform 101, jig elements 102 and a tensioning piece 104 that functions cooperatively with the jig elements 102. A carriage 106 is provided for movement along the platform 101 and driven by a motor unit 108, such as a low voltage electric motor, for example by a belt drive or drive screw which are schematically denoted as drive 110. The carriage 106 is equipped with an adhesive applicator mouth piece having nozzles (not shown) and indicated generally by reference numeral 112.

Figure 2:
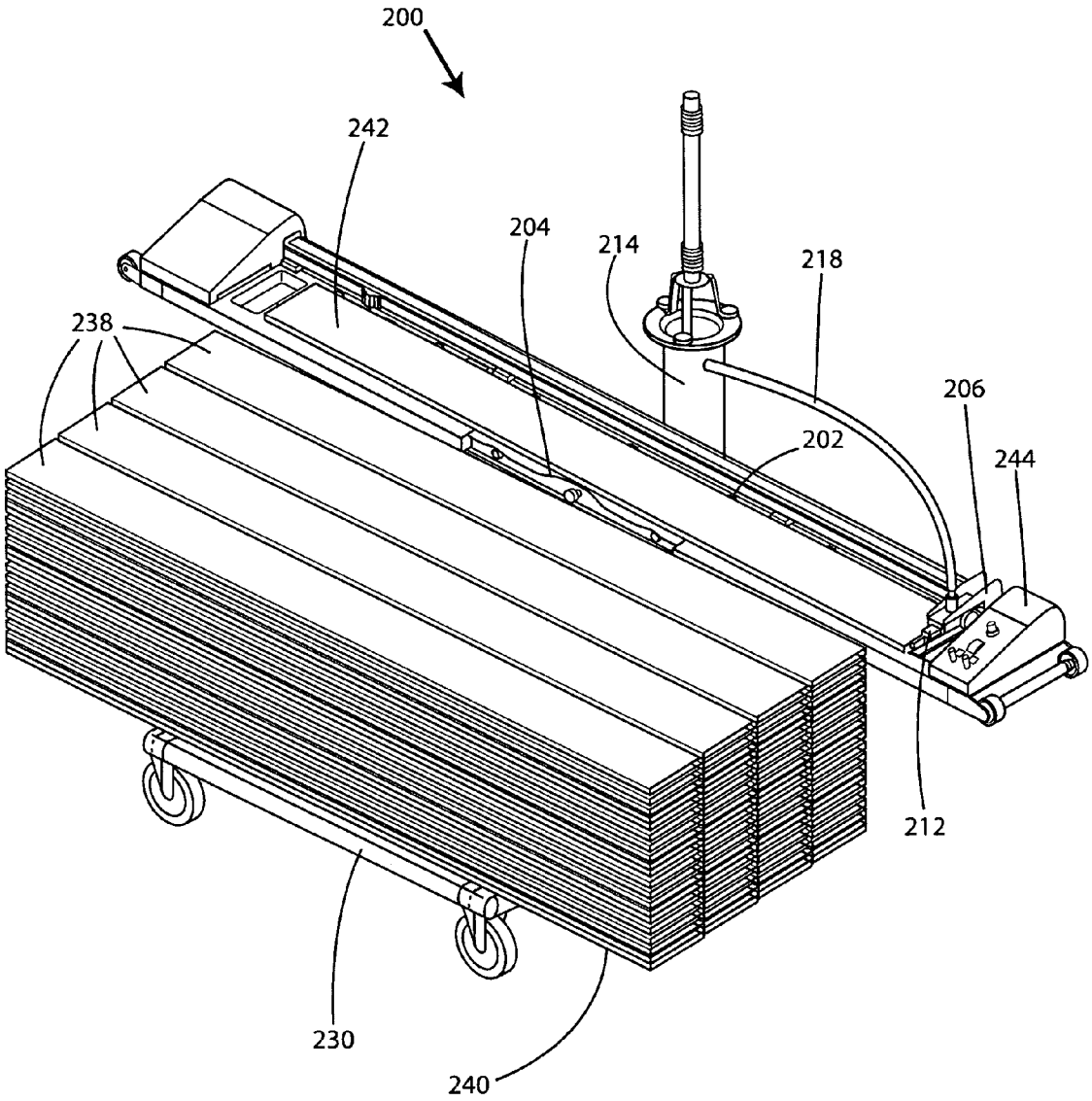
FIG. 2 is a perspective view of the embodiment of FIG. 1 with building elements located thereon.

An adhesive pump 114 is suitably provided to deliver pressurized adhesive to the applicator mouthpiece 112 located on the carriage via an inlet 116 on the mouthpiece 112. As seen in FIG. 2, a hose connection between the inlet 116 and the pump 114 feeds adhesive from a supply (not shown) to the inlet through a hose 218.

Referring again to FIG. 1, a holder 120 supports a plurality of building elements in a stacked supply thereof at a first location adjacent to the platform 101. The holder 120 is configured to be stepwise or step-free movable along or above the surface of a deck 130 sized and shaped to seat stacked supplies of building elements. A pair of motors 122, 124 drives a screw device (not shown) to adjust an upper level of a stacked supply at the first location and thereby change the level of the holder 120. A supply of stacked building elements is disposable on the holder 120 and is elevated after each removal of an uppermost building element 238 so that the upper level of the supply of building elements after each retrieval of a building element 238 assumes a predetermined level, as indicated in FIG. 2.

A conveyor 140 is also shown in FIG. 1, comprised of a moveable deck 130 which supports a plurality of wood stacks, a driver-interface 132 disposed at the edges of deck 130, roller assemblies 134, 134' enabling continuous movement of the deck 130 (e.g., in a closed loop), and cooperating driver motors 136, 136' providing bidirectional motive force to the conveyor 140. The conveyor 140 is operable to place the next stack, upon exhaustion of the current stack, in a position from which the uppermost member can be retrieved. Placement of the next stack can either be done automatically upon exhaustion of the previous stack, or can be operator-controlled.

As illustrated, deck 130 is flexible but can be implemented in other ways. For example, a series of parallel rigid rollers (e.g., 2, as illustrated) and a driver that urges the stacks of building elements toward the holder 120 can be employed. In this arrangement, the deck 130' can be essentially a closed-loop band manufactured of an elastomeric material possessing sufficient strength to move multiple wood stacks. The band is extended about roller assemblies 134, 134'. The band is preferably sufficiently taut to retain its shape when the stacks are disposed on the belt and throughout operation of the conveyor when loading the next stack of building elements onto the holder. The driver-interface 132 can take the form of holes, for example, sized and spaced to mate with and be driven by teeth provided near the ends of the roller assemblies 134, 134'. This arrangement (e.g., a sprocket connection) positively drives the deck 130 in response to rotation of the rollers 134.

According to yet another arrangement, the deck can be comparable to one of the several types of semi-rigid conveyor belts seen in airport baggage claim areas, wherein adjacent segments may not be connected to one another but are mutually supported by a common structure at their respective driver-interfaces. The driver-interface of this embodiment can also take the form of holes provided in the segments that are sized and spaced to accept gear teeth driven by the cooperating motors 136, 136'. Alternatively, the driver-interface can be raised posts or teeth designed to mate with components that transmit motive force such as gears, belts, chains or similar structures.

Another alternative is to implement deck 130 using a series of rigid rollers without a band, wherein the upper surfaces of the rollers collectively form the deck surface. The rollers are preferably spaced apart in such a way that they do not make contact with one another while rolling, yet are close enough to provide the necessary support for the wood stacks. Any or all of the rollers can interface with the driver and be able to receive power therefrom or the wood can be urged by a solenoid or other element across the rollers to the loading position.

Any chosen arrangement for the deck 130 will provide the user the option of using the driver to urge the next stack forward, or supplying the driving force himself by means of a push or pull of the stacks to the loading position. In order to facilitate operator push or pull operation, the driver is provided such that it does not impede the rolling motion of the rollers. The rollers themselves are preferably affixed to the device 100 by low-friction bearings or other suitable low-friction mountings.

Upon exhaustion of the current stack of building elements, it is desirable to commence the operation of loading a subsequent stack of building elements onto the holder 120. According to one arrangement, this operation can be triggered manually by the operator upon actuation of a switch provided on a control panel 144 using a stack already on the deck 130. The control panel 144 is provided to enable an operator to conveniently control the conveyor as well as adhesive-application operations of the carriage 106, and other functions of the apparatus. Actuation of the stack-loading switch causes the holder 120 to return to a receiving location, approximately level with the deck 130, at or after which time a subsequent stack of building elements can be urged onto the holder by movement of the deck. The force required to urge the next stack onto the holder can be supplied by the drivers or manually by the user as a push or pull, as noted above.

According to a preferred arrangement, commencement of the loading of a subsequent stack of building elements onto the holder is triggered automatically by the incorporation of a sensor 121. A possible implementation of the sensor is now described wherein an electronic sensor is operable to determine whether conditions appropriate to loading a subsequent stack exist. One condition sought by the sensor 121 is whether the holder 120 is at the top of its path of travel, e.g., approximately level with the platform 101. This can be implemented, for example, by sensing an electrical current or by closure or opening of an electromechanical switch caused when an electrical contact provided on the holder completes a circuit with an electrical contact provided near the platform. Another condition sensible by the sensor 121 to trigger loading of the next stack is the absence of a building element on the holder. This can be implemented, for example, by a light sensor provided near the platform at an appropriate level. An appropriate light-sensing level can be discriminated with a single building element being sufficient to prevent the detection of light by the sensor while the absence of a building element allows the detection of light. When the sensor arrangement 121 detects that the holder is at the top level, or that the last building element has been retrieved from the holder, or both, the urging of a subsequent stack of building elements onto the holder is triggered. Yet another sensing arrangement can comprise a counter and comparator circuit that tracks advancement of the holder toward its top position with regard to the thickness of the workpieces (wood) that have been selected at the control panel 144 under the influence of control unit 146, discussed below.

The apparatus preferably incorporates a number of safety features, including emergency power cutoff or "kill switch" features, that can be triggered by the above-described or other sensors. For example, an operator can use the control panel to set the apparatus to turn off automatically upon exhaustion of the current stack, as determined by sensor 121. Additionally, sensors can be provided that turn the apparatus off when adhesive application to the current building element is complete, or when the deck 130 and holder 120 become empty of building elements. Sensing an empty deck can be accomplished through the use of weight sensors (e.g., pressure transducers) or light sensors. A kill switch can also be provided that turns off the machine when an operator withdraws a building member, or simply pauses machine operation for an operator-selected period of time.

The apparatus 100 has preferably lockable wheels 126. Also, the apparatus 100 preferably has articulated arms 128 to make the chassis as narrow as possible for storage purposes.

FIG. 2 shows how the holder 220 in combination with deck 230 can be loaded with a plurality of stacks 238 of building elements, such as parquet elements. FIG. 2 also shows a building element 242 with its lower face facing upwards (that is, it is upside down) and located in the jig 202, 204 for application of adhesive by means of the carriage 206 and the adhesive applicator mouthpiece 212. The conveyor 240 is also mounted pivotally to the apparatus 200 so as to make transport or storage of the device more convenient.

Figure 3:
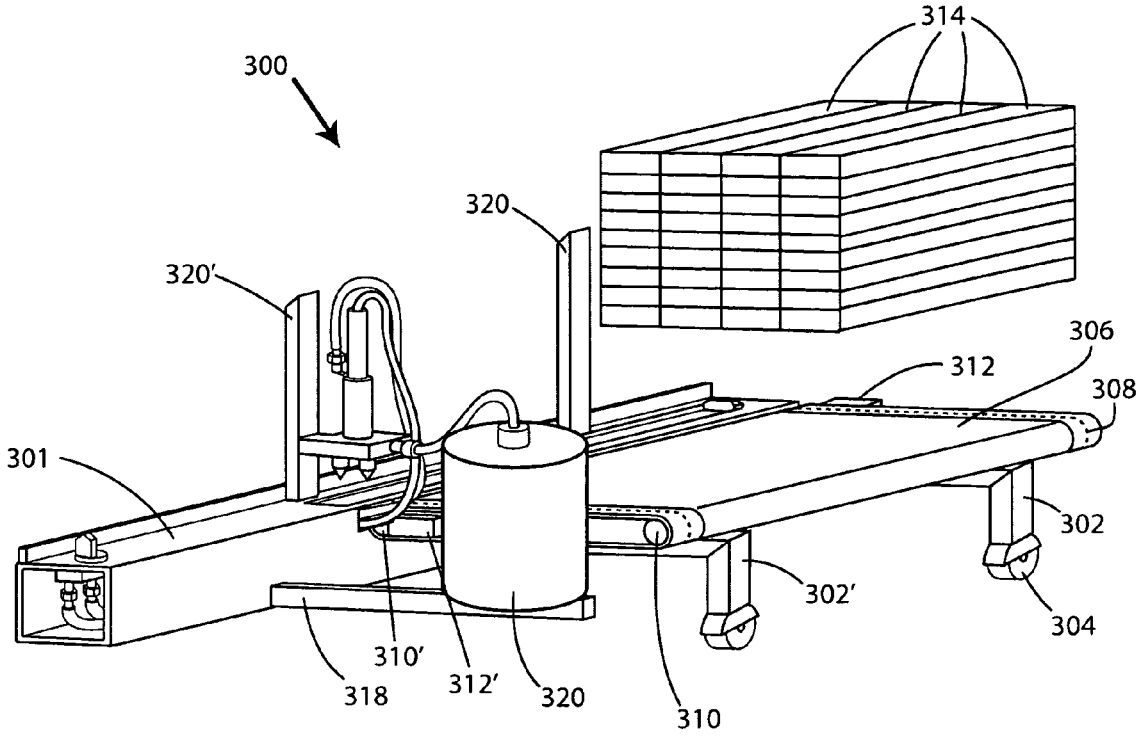
FIG. 3 is a perspective view of a second embodiment in accordance with the invention.

An apparatus 300 according to a second embodiment of the present invention is shown in FIG. 3, and includes a longitudinal beam 301 which forms the contact face on which adhesive is applied to a parquet panel. The beam also defines a first storage site for a stack of building elements. This beam is provided with wheels, and to this beam are attached bars 302, 302' with wheels 304, enabling the unit to be moved as the work progresses. The device includes a conveyor comprising a deck 306 which supports a plurality of wood stacks, a driver-interface 308 disposed at the edges of deck 306, roller assemblies 310, 310' enabling continuous movement of deck 306 in a closed loop, and cooperating motors 312, 312' providing bidirectional motive force to the conveyor. The conveyor is operable to place the next stack, upon exhaustion of the current stack, onto the longitudinal beam 301. Placement of the next stack can either be done automatically upon exhaustion of the previous stack, or can be operator-controlled. The deck also serves as a storage site for a plurality of wood stacks 314, from which individual stacks are transferred by the conveyor to the actual adhesive application table which forms another storage site for building elements which are to be glued, and each building element is pushed onto the beam 301 from the bottom of the stack for the application of adhesive. The beam 301 may also be made having one projecting bar 318 or more, which form a rest for an adhesive container 320.

Figure 4:
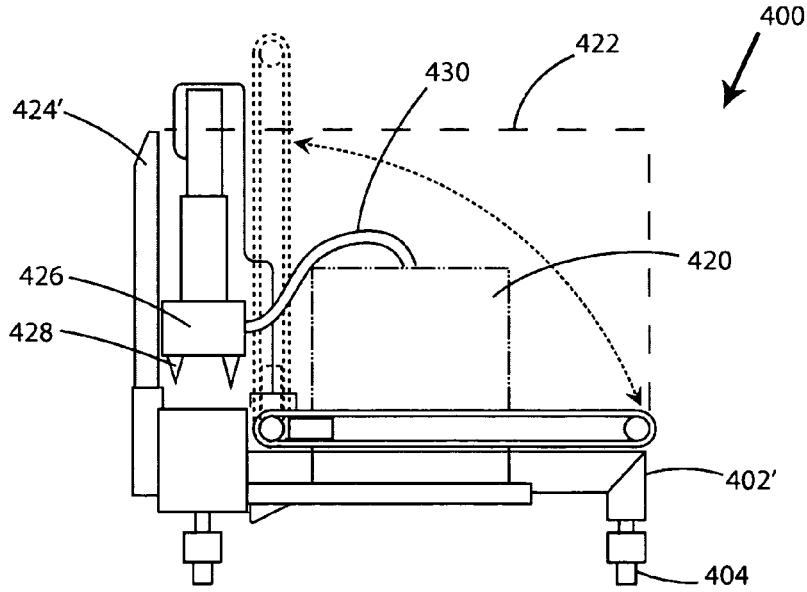
FIG. 4 is an end view of the embodiment of FIG. 3.

FIG. 4 shows a bearing plate 422 against which will abut one end of the stacks of wood. This bearing plate 422 may, for example, be releasably attached to the bar 402' and the upwardly projecting bar 424'. The bars 424, 424' constitute a side rest for the building elements to which adhesive is to be applied. One of the upwardly projecting bars 424' may also serve as an attachment bar for the adhesive applicator 426. The adhesive applicator 426 may be provided at one end thereof with one or more nozzles 428, the number of nozzles depending on how many strips of adhesive it is desired to apply to the building element, and the width of the building element or the article to which adhesive is to be applied. The adhesive device or adhesive pump is connected via a hose 430 to the adhesive tank 420. The adhesive tank 420 can be a container which is filled with adhesive or it can be formed by the packaging in which the adhesive is supplied, a hole being pierced in the lid of the adhesive container and the hose 430 with, for example, a tube being inserted into the adhesive container. In the illustrated exemplary embodiment the adhesive pump is attached to the bar 424', but there can instead be a separate attachment to ensure that the adhesive nozzles are above the building element which is pushed forward.

Figure 5:
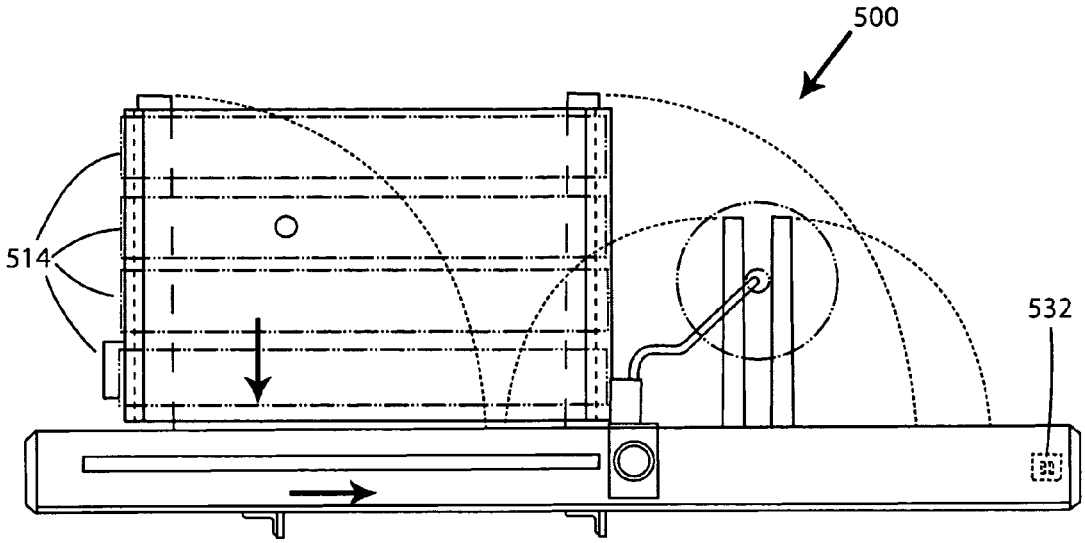
FIG. 5 is a top view of the embodiment of FIG. 3.
Figure 6:
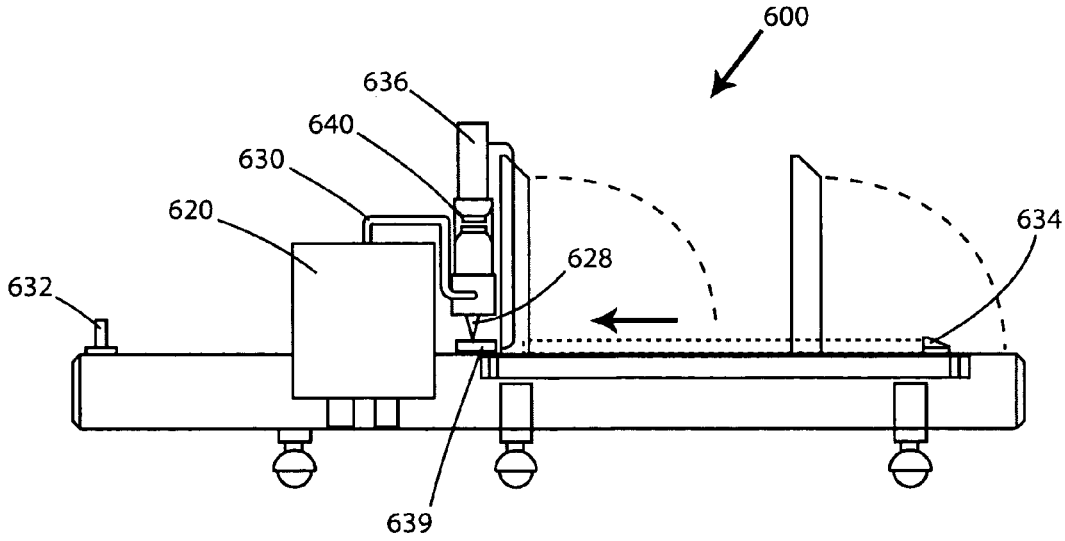
FIG. 6 is a side view of the embodiment of FIG. 3.

The application of adhesive may be semi-automatic or fully automatic. Referring to FIGS. 5 and 6, following actuation of a switch 532, 632, a pusher 634 pushes the building element under the nozzles 628. The pusher can comprise a solenoid having a disposed plunger. The plunger can be, for example, disposed substantially above the top level of the longitudinal beam, protruding from and traveling along a channel provided lengthwise on the top surface of the beam. The plunger is operable to urge a lowermost member of a stacked supply of building members lengthwise, along the top surface of the longitudinal beam and to continue to advance that member below the adhesive nozzles. The plunger can receive bidirectional motive force from a motor such as an electric motor. Alternatively, bidirectional motive force can be provided through the use of a compressor connected by an appropriate arrangement of hoses and regulator valves to the plunger.

The adhesive pump 636 is activated when the building element touches an activator 639 which can comprise, for example, a microswitch under the adhesive nozzles. Adhesive exits the nozzles 628 whilst the pusher 634 pushes the building element until it reaches the end switch 632. Actuation of end switch 632 by contact with the building element causes the pusher 634 to shut off until the building element is removed for placement on the floor. The operation is then repeated either automatically or by manually reactuating the switch 632. The pusher 634 may be operated electrically by an electric motor, hydraulically, or by other suitable drivers. The adhesive pump may, for example, be made of an air-driven piston 640 which presses the adhesive down, adhesive being sucked from the adhesive container 620 via the hose 630 on the return of the piston. The adhesive pump thus works on the same principle as a bicycle pump.

In the drawings the various bars are shown to be pivotal. The conveyor is mounted pivotally as well. This is so that the whole adhesive applicator can be folded up to give a simple elongate unit which can easily be transported from work site to work site.

Figure 7:
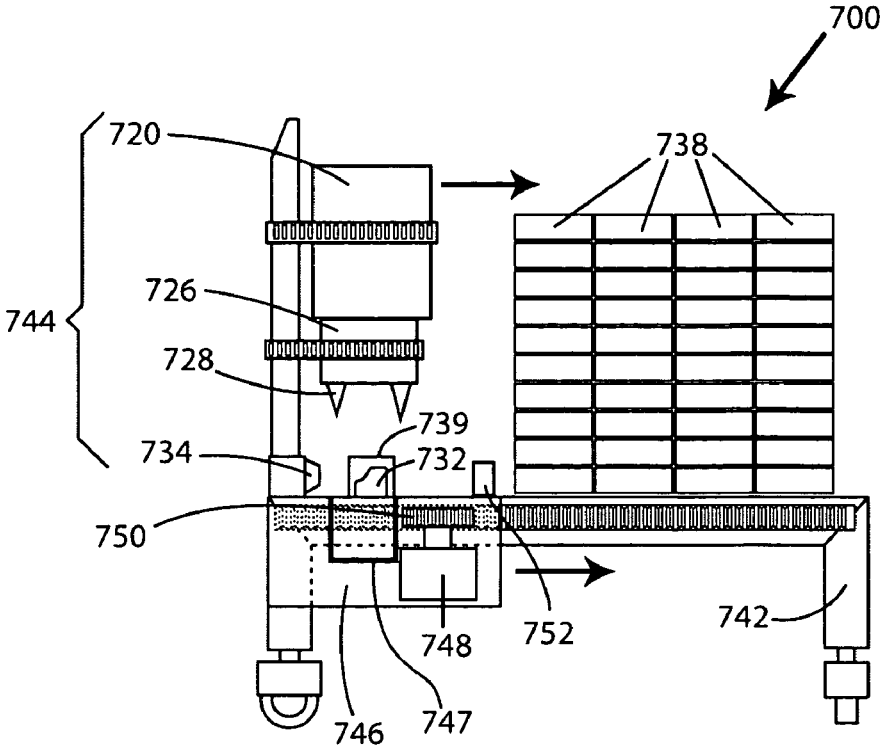
FIG. 7 is a view of another embodiment in accordance with the invention.

Another embodiment of the present invention is shown in FIG. 7, wherein the apparatus 700 comprises a frame 742 that constitutes a deck for storing a plurality of stacks of building elements. A glue station 744 is movably connected to the frame, wherein the glue station is an assembly built upon a carriage 746 that is movably connected to the frame 742. The glue station 744 also includes an elongate element 747 attached to the carriage, proximal to and substantially level with a top surface of the frame. There is an upper elongate contact face for members to which a coating, preferably adhesive, is to be applied. A coating applicator 726 with one or more nozzles 728 and associated adhesive supply container 720 are attached to the carriage and arranged above the contact face. A pusher 734 is attached to the carriage which travels lengthwise along and protrudes from a channel that is preferably disposed to the side of the lowermost member in the stack. Pusher 734 pushes a lowermost member in the stack along the deck and elongate contact face, under and past the coating applicator. One or more vertical projections 752 are also provided that rise vertically from the carriage. The vertical projections guide the lowermost member in the stack as it is being pushed under and past the coating applicator. Coating applicator 726 is activated when the building element touches an activator 739 which can comprise, for example, a microswitch under the adhesive nozzles 728. An end switch is provided at the end of elongate element 747 opposite the stacked supply. Actuation of the end switch 732 by contact with the building element ceases operation of the pusher 734 until the building element has been removed for placement on the floor. Movement of the glue station along the frame is accomplished by a driver motor 748, mounted to the carriage 746 and driving a gear assembly 750 that mates with teeth provided on the frame 742. Upon exhaustion of a current stack, the driver moves the frame to a position from which the lowermost member of a subsequent supply stack can be pushed onto and along the deck and elongate contact face, under and past the coating applicator.

A feature common to all embodiments of the present invention is that a coating applicator and a building element from a stacked supply are driven relative to one another to enable application of adhesive to the element, regardless of the number of stacks exhausted.

The apparatuses of the present invention can be equipped with a control unit 146 comprising a processor, a program, and memory coupled to the control panel 144. This allows a user to specify and control, either before or during operation of the device, the operation and function of the device. For example, a user can control the timing of the feeding of a next member from a stacked supply or allow that timing to occur automatically. In the latter case, a sensor can detect the absence of a building element from the platform or beam, at which time the program or separate control logic associated with the control unit commands retrieval of a next building element, at a time interval that can optionally be specified by the user.

The control unit 146 can also allow the specification of various sizes of building members to be handled by the apparatus. For example, the machine can be programmed to respond to a user selection of standard geometry parquet blocks and wooden slats by setting the operational drive signals to accommodate the selected geometry of building material. Thus, for example, if a user selects wooden slats of 1"×4" dimension, the conveyor 140 and holder 120 can be driven in the appropriate increment to suitably position each slat in a series of stacks for handling by the apparatus 100. Also, the control unit 146 can compute an appropriate speed or delay at which to provide adhesive coated building elements to a user. Alternatively, the speed or delay can be set manually.

The exhaustion of the current stacked supply can be detectable by a sensor integral to the device, and upon this occurrence control logic interfacing with the master control unit can direct the conveyor to place a subsequent supply stack in a position from which a subsequent supply stack member can be retrieved.

It will be appreciated by persons skilled in the art that the present invention is not limited to the embodiments described thus far with reference to the accompanying drawings; rather the present invention is limited only by the following claims.

We claim:

1. An apparatus for serially applying an adhesive onto members of a plurality stacks of building elements to provide for subsequent adhesive assisted attachment of the members to a surface, the apparatus comprising:

an elongate element having an upper elongate contact face for members to which a coating, preferably adhesive, is to be applied;

a coating applicator arranged above the contact face;

a storage site for a current stack of articles at one end of the elongate contact face;

one or more bars projecting sideways out from the elongate element;

a pusher means for pushing a lowermost member in the current stack onto and along the elongate contact face, under and past the coating applicator; and conveyor means for storing a plurality of stacks and operable to place a next stack, upon exhaustion of the current stack, in a position at one end of the elongate contact face from which the lowermost member of the next stack can be pushed onto and along the elongate contact face, under and past the coating applicator for applying the adhesive onto members of the plurality of stacks of building elements.

2. The apparatus according to claim 1, wherein the bar or bars are pivotally connected to the elongate element about a vertical axis.

3. The apparatus according to claim 1, wherein the bar or bars and the elongate element are provided with supporting wheels that allow translational movement along an underlying surface such as a floor.

4. The apparatus according to claim 1, wherein the storage site includes at least one vertical bar which projects upwards from one side of the elongate element.

5. The apparatus according to claim 4, wherein the vertical bar or bars are pivotally mounted on the elongate element about a horizontal axis.

6. The apparatus according to claim 1, wherein the coating applicator is mounted on the elongate element by means of a vertical bar which preferably is pivotally mounted on the elongate element about a horizontal axis.

7. The apparatus according to claim 6, wherein the coating applicator is connected to a coating container which is supported by a bar projecting horizontally from the elongate element, the bar preferably being pivotally mounted on the elongate element about a vertical axis.

8. The apparatus according to claim 1, wherein the pusher means receives motive force from an electric motor.

9. The apparatus according to claim 1, wherein the pusher means receives motive force from a compressor.

10. The apparatus according to claim 1, wherein the conveyor means is pivotally mounted to the apparatus.

11. The apparatus according to claim 1, wherein the conveyor means operation is selectable as automatic or manually controlled.

* * * * *